US008794790B2

(12) United States Patent
Hurtig

(10) Patent No.: US 8,794,790 B2
(45) Date of Patent: Aug. 5, 2014

(54) LIGHTING ELEMENT

(75) Inventor: Keijo Hurtig, Liminka (FI)

(73) Assignee: Naplit Show Oy, Liminka (FI)

( * ) Notice: Subject to any disclaimer, the term of this patent is extended or adjusted under 35 U.S.C. 154(b) by 165 days.

(21) Appl. No.: 12/811,849

(22) PCT Filed: Jan. 7, 2009

(86) PCT No.: PCT/FI2009/000001

§ 371 (c)(1),
(2), (4) Date: Sep. 13, 2010

(87) PCT Pub. No.: WO2009/087264

PCT Pub. Date: Jul. 16, 2009

(65) Prior Publication Data

US 2010/0328944 A1 Dec. 30, 2010

(30) Foreign Application Priority Data

Jan. 7, 2008 (FI) ..... 20085010 U

(51) Int. Cl.
*F21V 13/00* (2006.01)

(52) U.S. Cl.
USPC ..... 362/243; 362/346

(58) Field of Classification Search
USPC ..... 362/241–243, 245, 247, 296.01, 297, 362/300–302, 343, 346–350
See application file for complete search history.

(56) References Cited

U.S. PATENT DOCUMENTS 1,685,609 A * 9/1928 McClure ..... 362/241
3,395,272 A 7/1968 Nicholl
3,539,801 A * 11/1970 Bobrick Mitchell ..... 362/297
4,081,667 A * 3/1978 Lewin et al. ..... 362/296.04
4,494,176 A 1/1985 Sands et al.
4,943,901 A 7/1990 Baldwin et al.
5,093,768 A * 3/1992 Ohe ..... 362/241
5,833,358 A * 11/1998 Patik ..... 362/391
5,921,666 A 7/1999 Preston et al.

(Continued)

FOREIGN PATENT DOCUMENTS

CN 1530688 A 9/2004
DE 196 20 659 A1 11/1997
EP 1 033 530 A2 9/2000

OTHER PUBLICATIONS

Chinese Office Action, in Patent Application No. 200980101774.

(Continued)

*Primary Examiner* — Julie Bannan
(74) *Attorney, Agent, or Firm* — Young & Thompson

(57) ABSTRACT

A lighting element for which it is possible to assemble various lighting arrangements includes at least one light source, a reflecting surface and elements for supplying power to the light source, which is kept substantially above the reflecting surface supported by a support element, whereby light emitted everywhere by the light source can be effectively utilized. The reflecting surface directs the light substantially in the lighting direction of the lighting element past the light source. Around the light source, there is a collar structure manufactured of light-reflecting material which controls the light substantially in the lighting direction. Covers and a stand of the lighting elements are designed such that it is possible to join the lighting elements together to form a lighting arrangement. In the reflecting surface, there can be a protrusion which reflects light fallen on it past the light source in the lighting direction. The light sources obtain their power via the support elements.

18 Claims, 10 Drawing Sheets

(56) References Cited

U.S. PATENT DOCUMENTS

Figure 1:
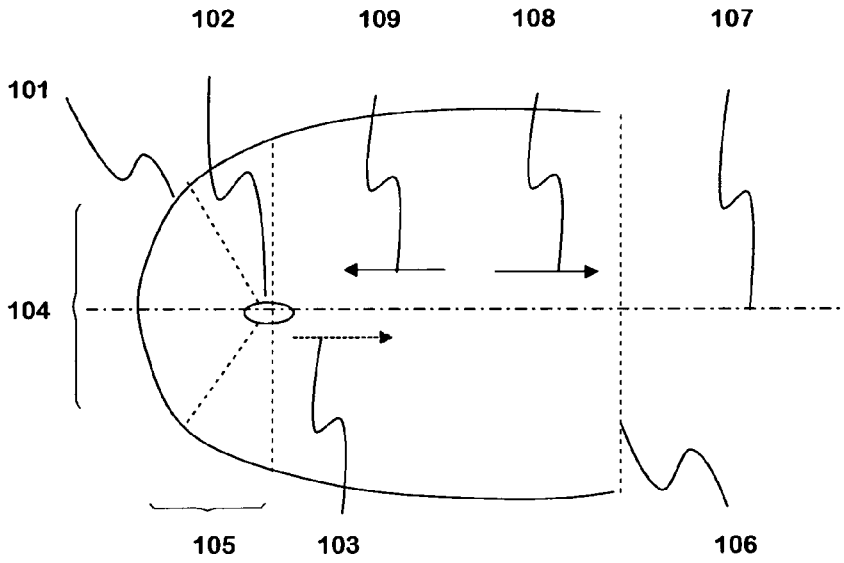

| | | | | |
|---|---|---|---|---|
| 6,068,388 | A * | 5/2000 | Walker et al. | 362/304 |
| 6,234,645 | B1 | 5/2001 | Borner et al. | |
| 6,283,613 | B1 * | 9/2001 | Schaffer | 362/245 |
| 6,657,393 | B2 * | 12/2003 | Natsume | 315/82 |
| 6,786,625 | B2 * | 9/2004 | Wesson | 362/545 |
| 7,246,917 | B2 | 7/2007 | Rhoads et al. | |
| 2005/0231974 | A1 | 10/2005 | Ruffin | |
| 2006/0139933 | A1 | 6/2006 | Lin et al. | |
| 2006/0268548 | A1 * | 11/2006 | Chang | 362/245 |
| 2007/0211473 | A1 * | 9/2007 | Peck | 362/341 |
| 2008/0219000 | A1 * | 9/2008 | Fan | 362/241 |

OTHER PUBLICATIONS

International Search Report, dated May 11, 2009, from corresponding PCT application.

* cited by examiner

LIGHTING ELEMENT

The invention relates to a lighting element which comprises one or more light sources, a reflecting surface and means for supplying power to the light source.

Generally, the light sources of light fittings, such as e.g. filaments, halogen tubes, light emitting diodes, gas-discharge lamps and equivalents, emit light in every direction. However, lighting is usually required at some certain direction or target where this elsewhere emitting light would be useful to control. This elsewhere emitting light has generally been controlled in the direction of the target with various reflectors or lens systems surrounding the light source. In practice, part of the light of the light source remains unutilised due to the structure of the light source and the light fitting.

The use of small light sources in illumination is problematic, because they do not supply a lot of light individually and produce a point source of light due to their small size. Packing small light sources very closely, again, causes the light sources to heat up, which shortens their operating life.

Patent publication U.S. Pat. No. 5,921,666 describes a lighting fixture recessed in the ceiling. There is a reflecting surface with multiple ellipsoidal segments which have a common focal point. The lighting fixture is covered by a planar structure in which there is a slot at the point of the common focal point. Each ellipsoidal segment has its own light source the light of which is collected and directed via the slot for the illumination purpose. The reflecting surface can in this arrangement become quite complex. Furthermore, some light of the light sources goes to waste. Also, reducing the size of the lighting fixture is problematic and the shaping or directing of the light beam is not possible.

Patent publication U.S. Pat. No. 7,246,917 describes a lighting element using a light emitting diode lamp as the light source, of which element it is possible to construct a tower-like light fitting. In this arrangement, some light of the light source goes to waste and the lighting element is only suitable for constructing a specific structure. Similarly, the shaping or directing of the light beam is not possible.

The object of the invention is to introduce a lighting element by means of which flaws and disadvantages related to known prior art can be substantially minimised.

The objects according to the invention are achieved by means of a lighting arrangement which is characterised by what is presented in the independent claim. Some advantageous embodiments of the invention are described in the dependent claims.

The basic idea of the invention is a lighting element which uses the light of its light source as effectively as possible. The lighting element consists of one or more light sources, a reflecting surface and means for supplying power to the light source. According to the invention, the light source or light sources of the lighting element are located in respect of the reflecting surface so that light coming from the light source in the direction of the reflecting surface is arranged to be reflected past the light source in the lighting direction of the lighting element. Then, the light of the light source emitting everywhere can be utilised as effectively as possible when the light source itself does not operate as a shading factor. The reflecting surface is located or designed so that it directs light substantially in the lighting direction of the lighting element. By shaping the reflecting surface and directing and positioning the light sources, light reflected from the reflecting surface is directed past the light source or light sources in the lighting direction. Advantageously, light coming from the light source in the direction of the reflecting surface is reflected in the lighting direction via one reflector.

In an advantageous embodiment of the lighting element according to the invention, the part of the reflecting surface which is close to the bottom of the lighting element, i.e. the part in the opposite direction of the lighting direction of the lighting element, is at least partially parabolic. In another advantageous embodiment of the lighting element according to the invention, the part of the reflecting surface which is close to the bottom of the lighting element is even. The reflecting surface is arranged to reflect light fallen on it past the light sources.

In an embodiment, there can be a protrusion or an equivalent shaping in the reflecting surface of the lighting element. This protrusion is substantially below the light source of the lighting element i.e. in the part of the reflecting surface of the lighting element which is close to the bottom of the lighting element so that the protrusion reflects light failing on it substantially past the light source in the lighting direction of the lighting element. The protrusion is designed such that the light come to it from the light source is principally reflected directly in the lighting direction i.e. the light undergoes only one reflection. Advantageously, the sides of the protrusion are curved and it has a peak. The protrusion can also be asymmetric. There being several light sources in the lighting element, each light source has its own protrusion or the protrusion is designed such that it is able to reflect the light of all light sources. It is also possible to arrange several protrusions of which each reflects the light of one or more light sources. The protrusion can also be a ridge-like structure. The sides of this ridge-like structure can be curved and the peak pointed. To control the light past the light source in the lighting direction, it is also possible to use in some embodiments the locating and positions of the light sources and other shapes of the reflecting surface in addition to protrusions.

In an embodiment, the walls of the reflecting surface have been stepped according to the Fresnel reflecting surface. Substantially, the stepping is on the plane of the light source and from there towards the bottom of the lighting element. In an embodiment, there is below the light source a cavity designed in the reflecting surface which reflects light past the light source in the lighting direction.

Support elements of the light sources of the lighting element according to the invention are designed such that they disturb the travel of light as little as possible in the lighting direction of the lighting element. In an embodiment, the light sources obtain their power via the support elements. In an embodiment, the surface of the support elements is of light-reflecting material. In an embodiment, the support elements are implemented with light sources surrounded by collar structures.

A collar structure according to the invention fastened in the light source controls light emitting sidewards of the light source substantially in the lighting direction of the lighting element. The collar structure is a structure which substantially opens in the lighting direction. In an embodiment, the collar structure conveys heat produced in the light source away from the light source. In another embodiment, the collar structure reflects light both from its inner and outer surfaces. The shape of the collar structure can affect the reflection of light. In an embodiment, the collar structure is designed such that the light sources surrounded by collar structures are locatable into connection with each other. Advantageously, the shape of the collar structure is a hexagon. In an embodiment, the light sources surrounded by collar structures are positioned as a circle. The collar structures of different light sources of the same lighting element can be of various sizes and shapes. The inner and outer surfaces of the collar structure can be of different shapes. The inner and outer surfaces of the collar structure have been designed to control the reflection of light. The inner surface of the collar structure can e.g. be stepped in an embodiment. Also the outer surface of the collar structure can be stepped.

It is possible to assemble various lighting arrangements of the lighting elements. The lighting arrangement consists of one or more lighting elements. The covers and the stand of lighting elements are designed such that it is possible to join lighting elements together. In an embodiment, the covers and the stand of the lighting elements are designed such that lighting elements are arrangeable as a plane. Then, it is possible to constitute surfaces or patterns of various shapes of the lighting elements. In another embodiment, the covers and the stand of the lighting elements are designed such that the outer surface emitting light of the lighting arrangement constituted of lighting elements forms a curved surface. In an embodiment, the cover and the stand of the lighting elements are designed such that they constitute a curved surface so that the lighting element forms a separate light fitting.

In an embodiment, the covers and the stand of the lighting element are designed in the form of an equilateral hexagon.

In an embodiment, the light source of the lighting element is an electric light source and the power is electric current. Advantageously, the light source is a LED light. In another advantageous embodiment, the light source is a filament.

An advantage of the invention is that the luminous efficiency of the light source can be more effectively utilised when it controls the previously unutilised light of the light source in the lighting direction. Furthermore, it diffuses light when using small-sized light sources which otherwise would produce point light.

Additionally, an advantage of the invention is that it enables the use of low-powered light sources whereby energy is saved. Light sources employing less energy also heat up less and have a longer life.

Furthermore, the collar structure of the lighting element according to the invention supports the light source and conveys heat away from the light source. The collar structure also enables arranging various light source arrays in the lighting element. By means of the collar structure, the lighting direction of the light source can be adjusted. The collar structure also enables implementing the support elements of the lighting element with light sources surrounded by collar structures.

A further advantage of the invention is that it is possible to easily assemble of the lighting elements various lighting arrangements for different intended uses and targets. With lighting arrangements according to the invention, it is possible to illuminate large surfaces considering the shape of the surface being illuminated and the illumination requirements at different points.

Figure 3:
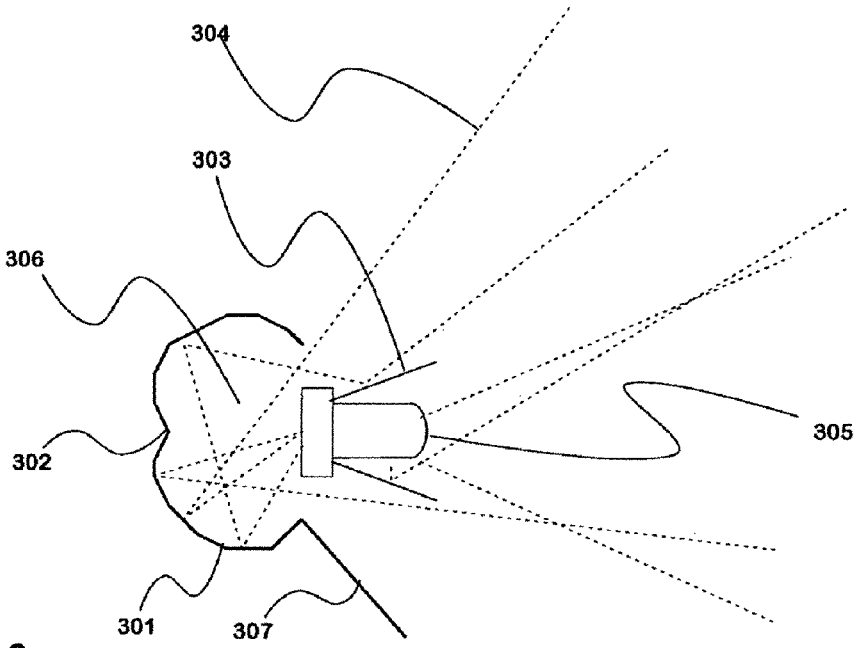
Figure 4:
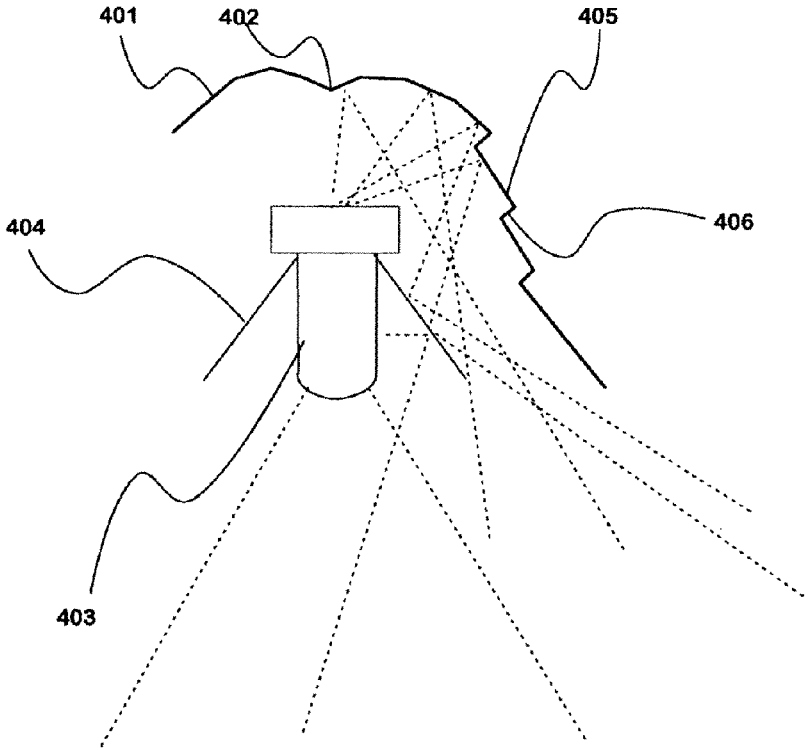
Figure 5:
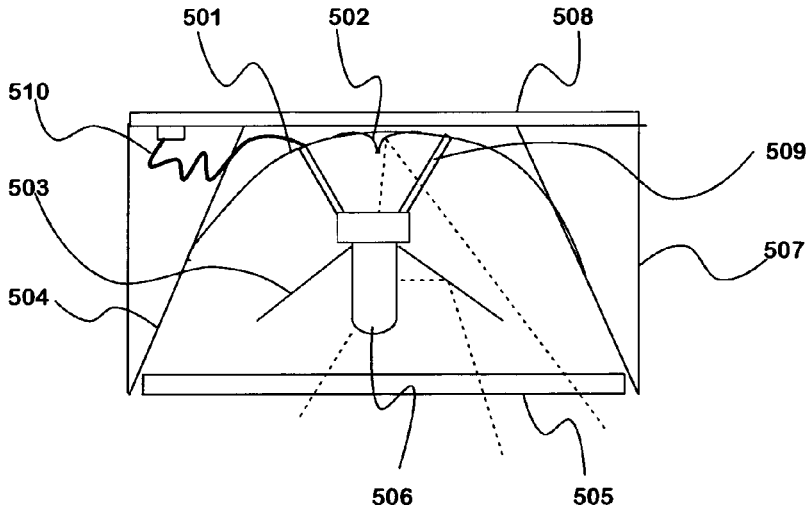
Figure 6:
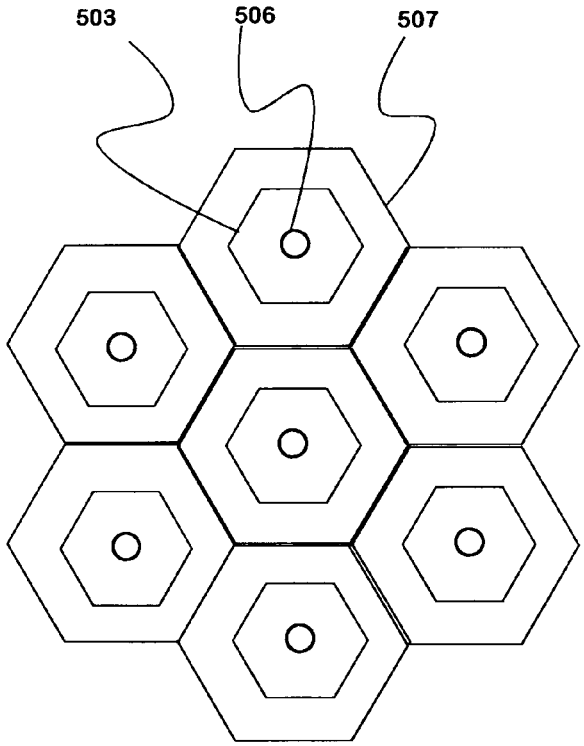
Figure 7:
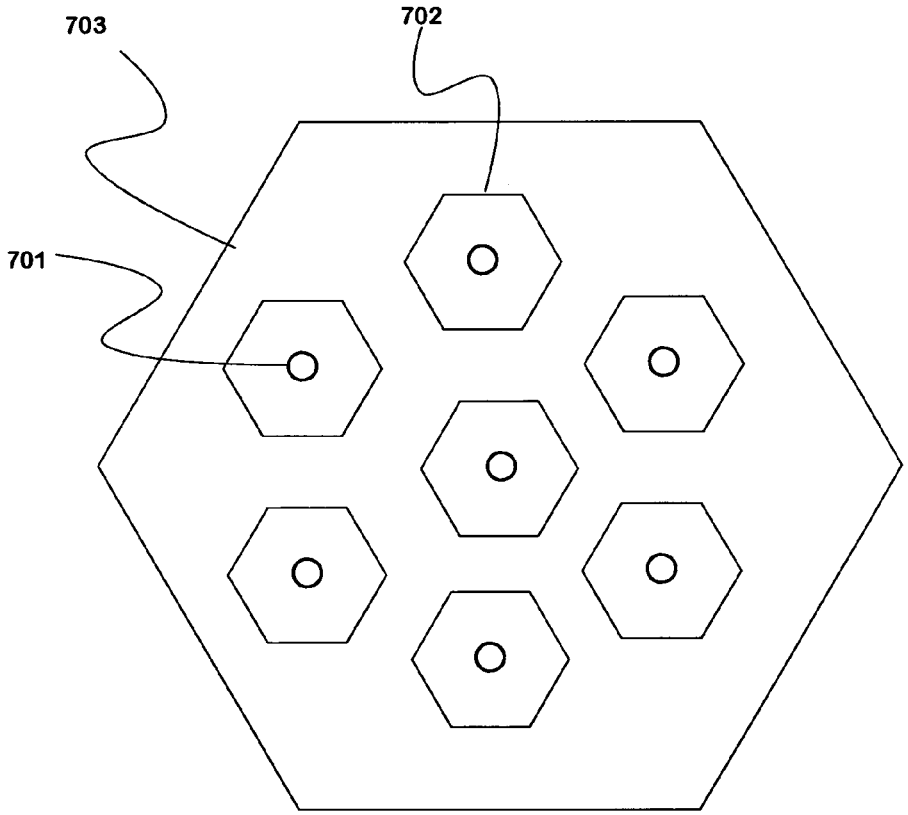
Figure 8:
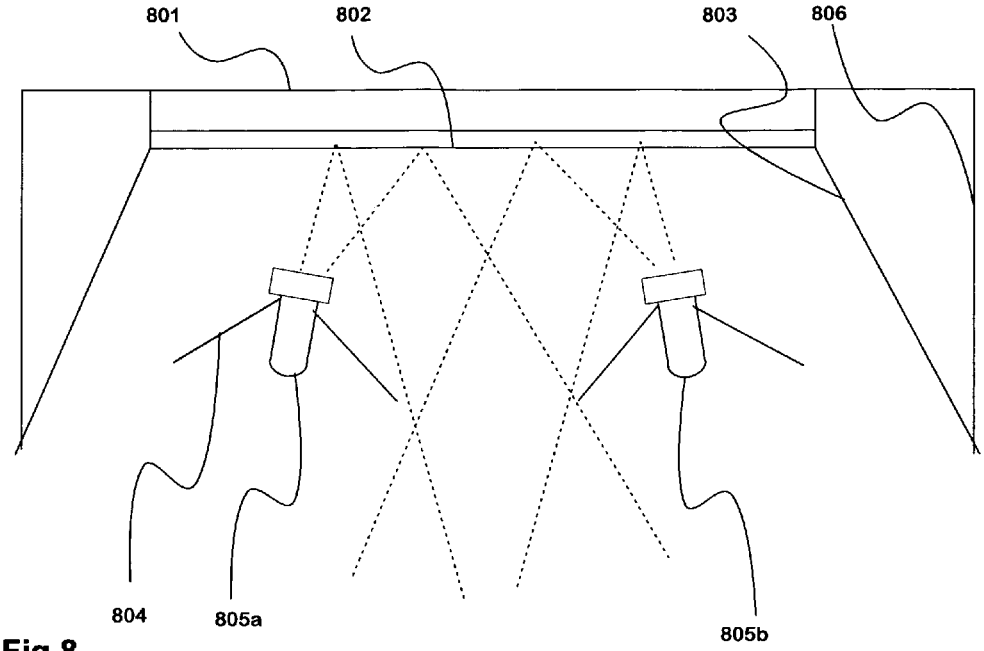
Figure 9:
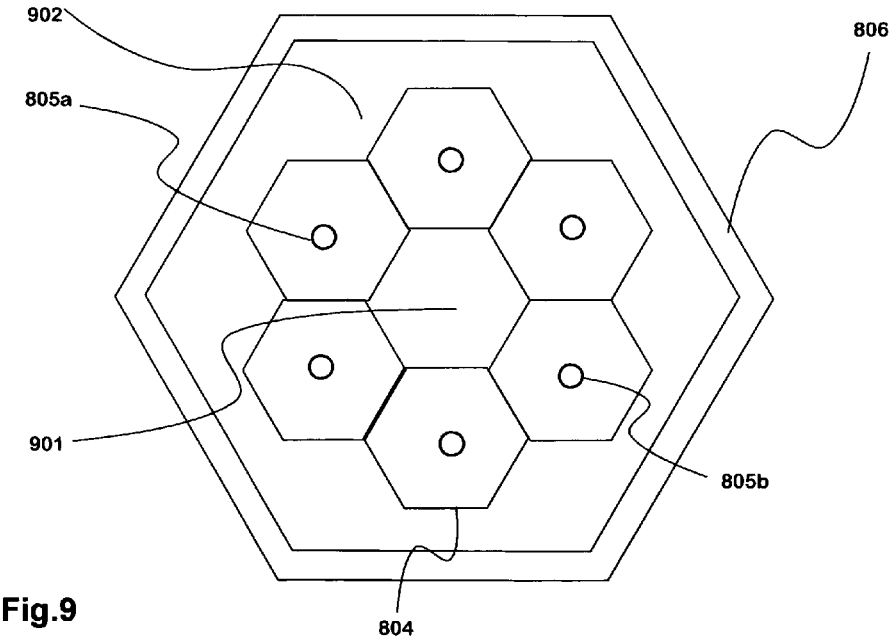
Figure 10:
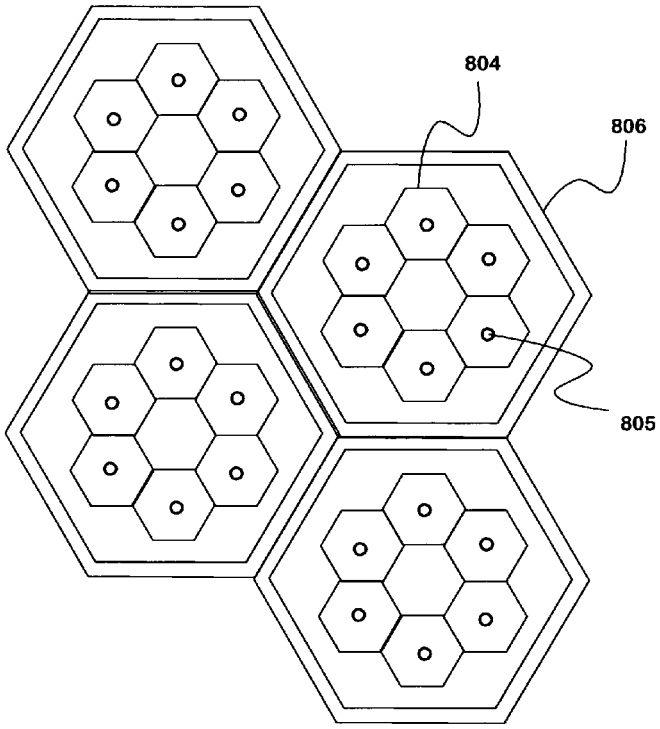
Figure 11:
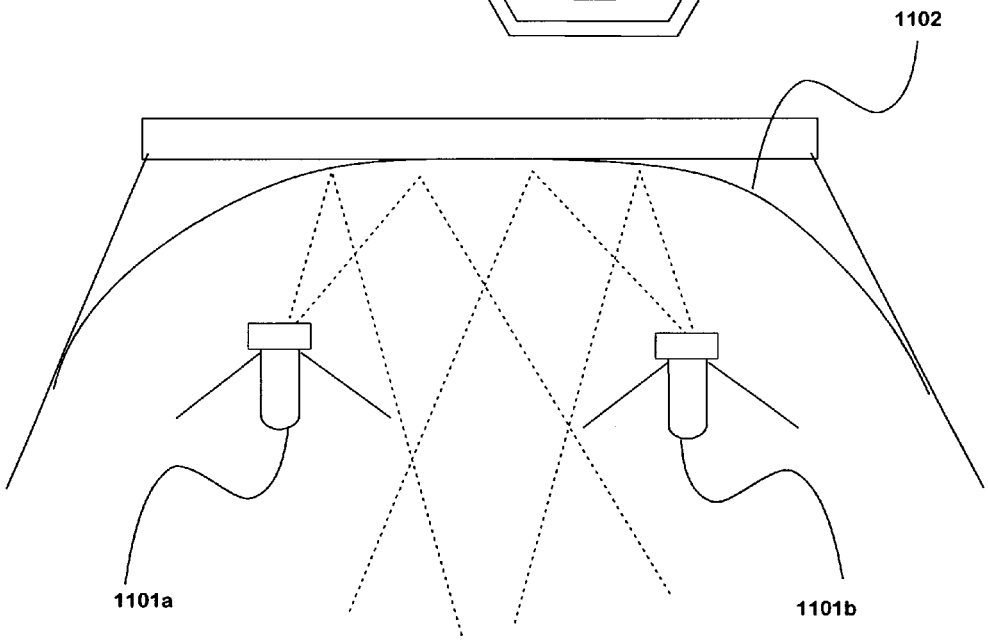
Figure 12:
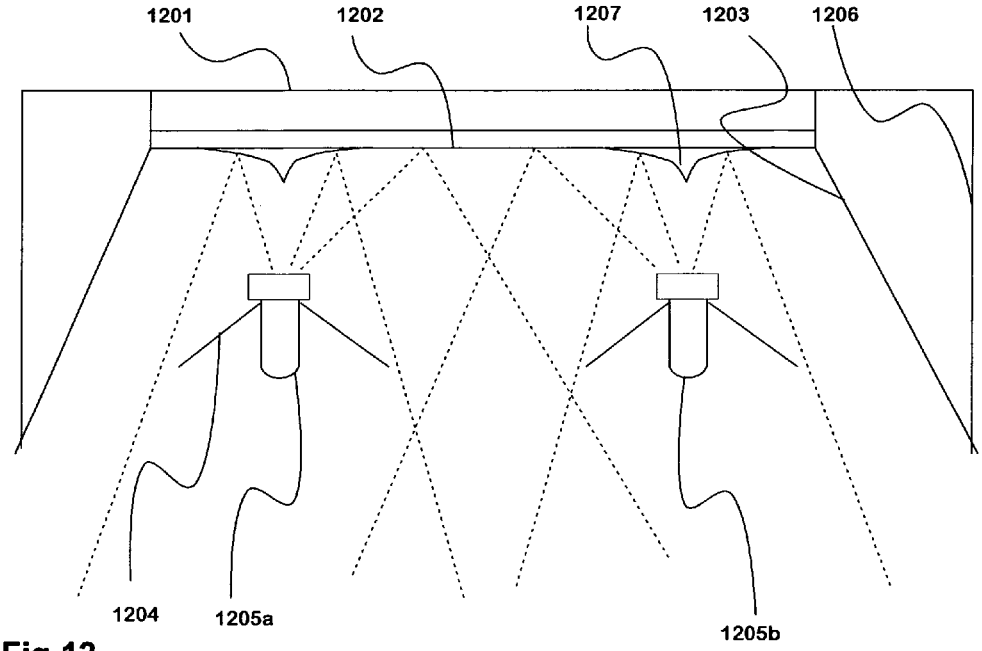
Figure 13:
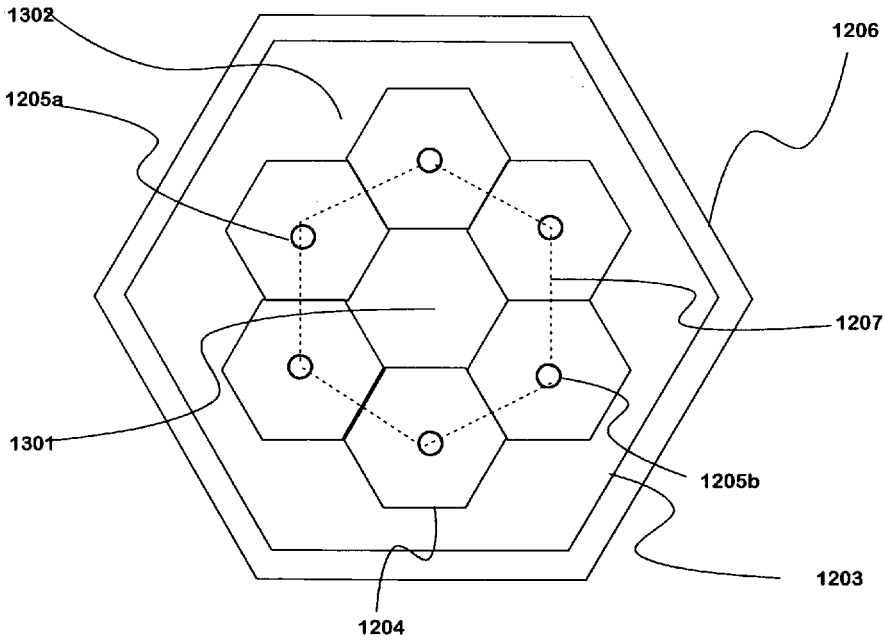
Figure 14:
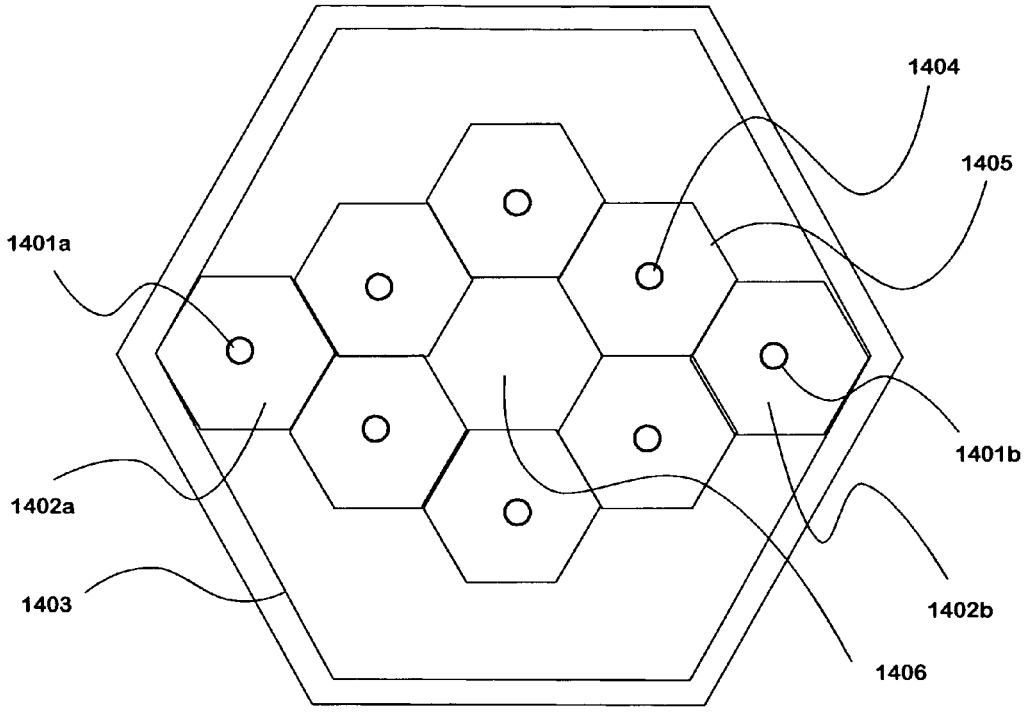
Figure 15:
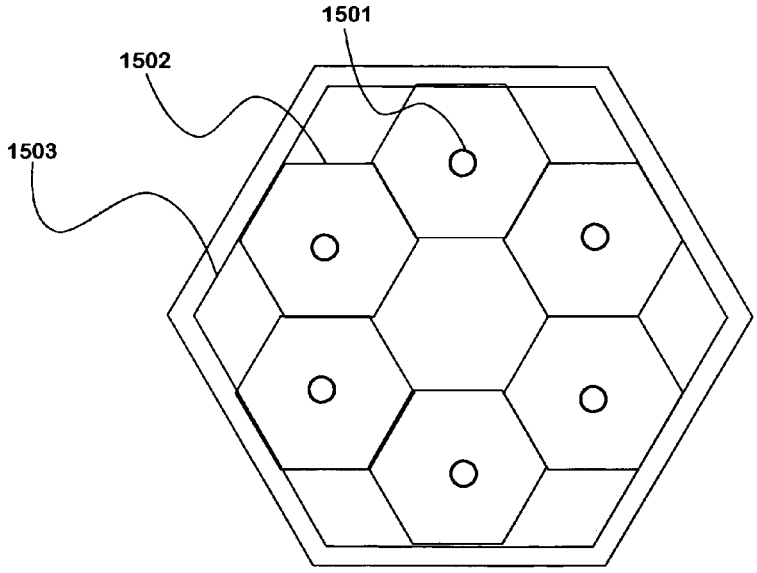
Figure 16:
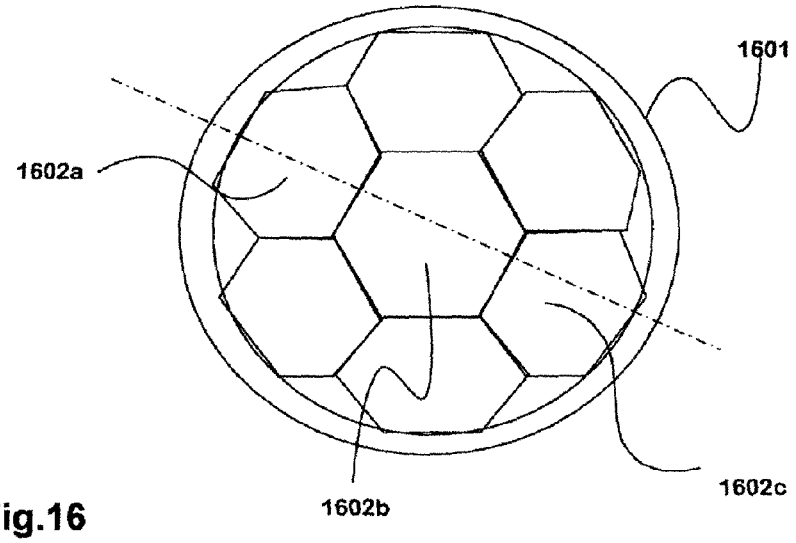
Figure 17:
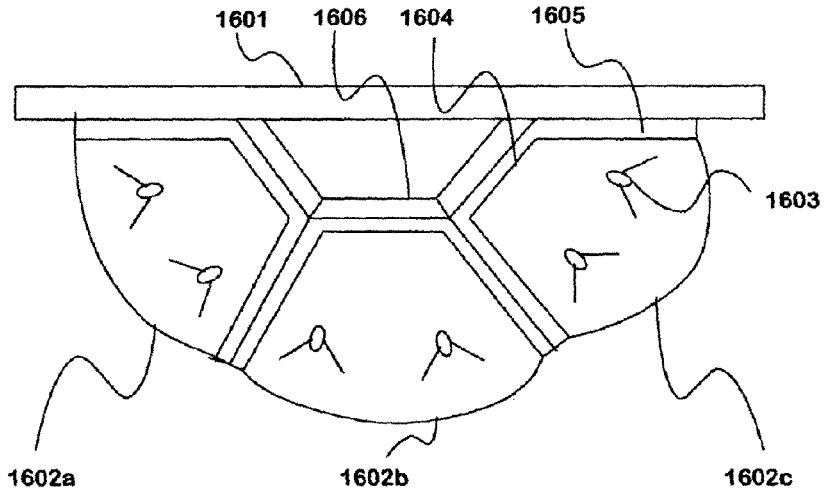
Figure 18:
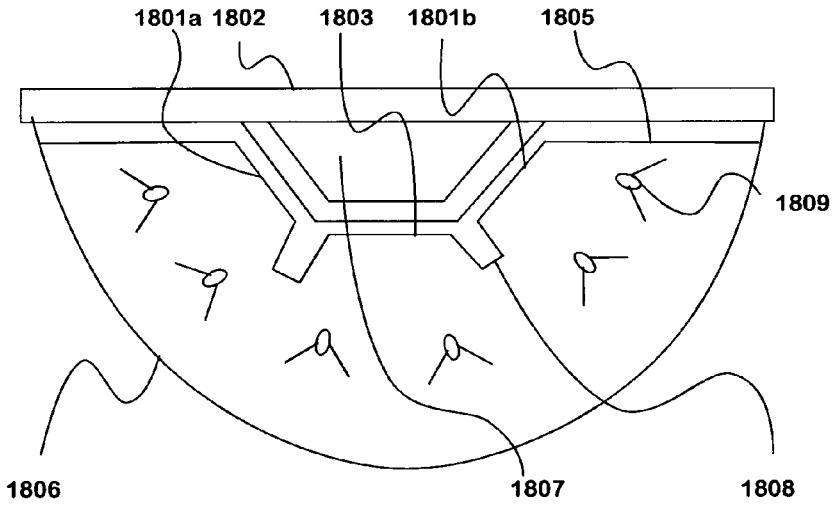

The invention will now be described in detail. The description refers to the accompanying drawings in which FIG. 1 shows directions and designations used when describing the invention, FIG. 2 shows by way of an example a light source, a reflecting surface and a collar structure of a lighting element according to the invention, FIG. 3 shows by way of an example a light source and a shaped reflecting surface of a lighting element according to the invention, FIG. 4 shows by way of an example a light source and a shaped reflecting surface of a lighting element according to the invention, FIG. 5 shows by way of an example a side view of a lighting element according to the invention, FIG. 6 shows by way of an example a lighting arrangement assembled of the lighting elements shown in FIG. 5, FIG. 7 shows by way of an example a lighting element according to the invention, FIG. 8 shows by way of an example a side view of a lighting element according to the invention, FIG. 9 shows the lighting element according to FIG. 8 seen from the lighting direction, FIG. 10 shows a lighting arrangement assembled of the lighting elements shown in FIG. 8, FIG. 11 shows by way of an example a side view of a lighting element according to the invention, FIG. 12 shows by way of an example a side view of a lighting element according to the invention, FIG. 13 shows the lighting element according to FIG. 12 seen from the lighting direction, FIG. 14 shows by way of an example a lighting element according to the invention in which support elements have been implemented by light sources surrounded by collar structures, FIG. 15 shows by way of an example another lighting element according to the invention in which support elements have been implemented by light sources surrounded by collar structures, FIG. 16 shows by way of an example a lighting arrangement according to the invention, FIG. 17 shows a cross section of the lighting arrangement of FIG. 14, and FIG. 18 shows by way of an example a lighting element according to the invention.

FIG. 1 shows a simplified lighting element by means of which designations used are illustrated. The lighting element consists of a reflecting surface 101 and a light source 102. A lighting direction 103 of the lighting arrangement element is the direction in which the light of the lighting arrangement element has been substantially designed to go. Downwards of the light source is the opposite direction in respect of the lighting direction of the lighting arrangement element. Sidewards of the light source is substantially transverse in respect of the lighting direction of the light source. A bottom 104 of the reflecting surface is the part of the reflecting surface which is substantially below the light source. A bottom 105 of the lighting element is the area of the lighting element which is located below the plane of the light source. An opening surface 106 of the lighting element is the area from which light comes out from inside the lighting element. The bottom of the lighting element and the opening surface of the lighting element are substantially on the opposite sides of the lighting element. A longitudinal axis 107 of the lighting element goes through the bottom and the opening surface of the lighting element and in relation to it the parts of the lighting element are located substantially symmetrically. Upwards 108 of the lighting element refers to the direction parallel to the longitudinal axis from the bottom of the lighting element towards the opening surface 106 and downwards 109 refers to the opposite direction. The lighting direction 103 can diverge from the up- and downwards directions, because the lighting direction can in some cases be wide, convergent or directional, whereby in the wide lighting direction the rays of light disperse and in the directional they are substantially either parallel or narrowing.

Figure 2:
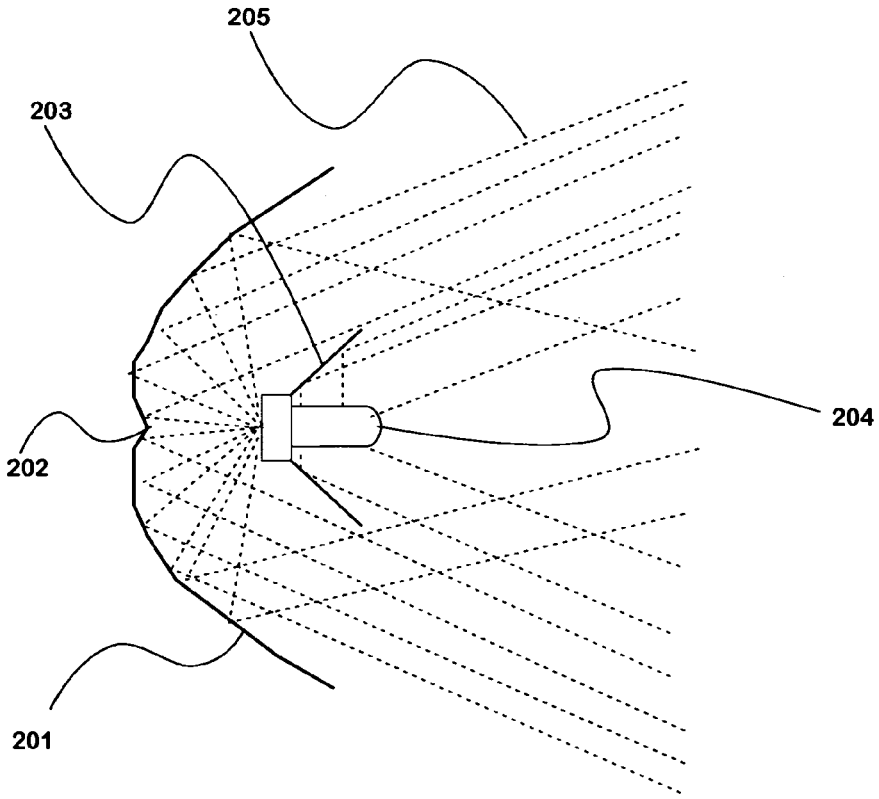

FIG. 2 shows by way of an example an arrangement according to the invention for the effective use of light of a light source of a lighting element. In the lighting element, there is a light source 204. The light source is located above a reflecting surface 201. The light source is kept in place by support elements (not shown in the figure) via which the light source can be provided with its power. The light source emits light substantially in every direction: upwards, downwards and sidewards of the light source. Rays of light 205 emitting from the light source are designated with dash lines. Similarly in the other figures, the dash lines illustrate the travel and reflections of rays of light coming from the light source.

The reflecting surface 201 is of light-reflecting material. It is partially parabolic, whereby it directs light fallen on it. Advantageously, the shape of the reflecting surface has been chosen such that light coming downwards of the light source 204 is substantially reflected in the lighting direction via one reflector. FIG. 2 shows the parabolic section of the reflecting surface which extends in this example substantially on the plane of the light source. The shape of the reflecting surface in the area upwards from the light source can be e.g. a funnel opening upwards. The reflecting surface substantially covers the inner surface of the lighting element. The reflecting surface of the lighting element can consist of several different shapes and it can be asymmetric.

In the reflecting surface 201, substantially below the light source 204, there is a protrusion 202 diverging from the parabolic shape. This protrusion is located and designed so that it directs light fallen on it substantially in the lighting direction and past the light source. The shape of the protrusion can be uniform or asymmetric, depending on the location and position of the light source.

In the light source 204 is fastened a collar structure 203. The collar structure is designed such that it substantially opens in the lighting direction. The collar structure is fast of its narrower end in the light source. The collar structure is fastened so that it does not prevent the passage of light downwards of the light source 204. At the narrower end of the collar structure, there is a hole reserved for the light source, whereby the light source comes visible from the hole in question unobstructedly. Then, it is possible to reflect the light coming downwards of the light source via the reflecting surface 201 and the protrusion 202 in it past the light source in the lighting direction. The support elements keeping the light source in place are advantageously fastened in the collar structure. The collar structure is of light-reflecting material at least of its inside. The inner surface of the collar structure reflects light coming sideways from the light source 204 substantially in the lighting direction. This lighting direction can be altered by changing the inclination and shape of the inner surface of the collar structure. The outer surface of the collar structure can also be reflective, whereby light falling onto it is reflected back on the reflecting surface 201 and from there in the lighting direction. The collar structure is also arranged to convey heat away from the light source. The shape of the collar structure seen from the lighting direction can be e.g. circular or that of a regular polygon. There being several light sources in the lighting element, the collar structures of different light sources can be of various sizes and shapes and directed differently. The collar structures can be used with several light sources to connect light sources together and to constitute a sturdy structure. In an embodiment, the support elements are constituted of light sources surrounded, by collar structures. The shape of the collar structure can be, e.g. that of an opening cone, ellipsoidic, parabolic or a combination of several different shapes. In an embodiment, the inner and outer surfaces of the collar structure have been designed differently, i.e. their shapes do not correspond each other. For instance, the outer surface of the collar structure can be of parabolic shape and the inner surface of conical shape or stepped.

FIG. 3 shows an example in which the bottom of a reflecting surface 301, the part which is below a light source 305, is parabolically designed and it has a protrusion 302 below the light source. The protrusion is designed and located so that light coming downwards of the light source is reflected from the protrusion past the light source. After the parabolic bottom, the reflecting surface curves inwards so that the reflecting surface forms a circular cavity 306. The curvature of the cavity stops before it closes and the reflecting surface starts to open. This opening part 307 of the reflecting surface can be e.g. funnel-like or curved or parabolic.

The light source 305 has a collar structure 303. The collar structure controls the light emitting sidewards of the light source in the lighting direction. The light emitting downwards of the light source is controlled by the cavity 306 constituted of the reflecting surface 301 and the protrusion 302. These control the light both directly past the light source and reflecting via the collar structure and the reflecting surface substantially in the lighting direction.

The structure shown in FIG. 3 enables manufacturing the lighting element smaller of its diameter than e.g. in the embodiment shown in FIG. 2.

FIG. 4 shows a special case of the embodiment of FIG. 3. Here, the walls of the cavity being constituted of the reflecting surface below the light source are stepped, whereby they form a Fresnel reflecting surface. The Fresnel reflecting surface is an equivalent arrangement to the Fresnel lens in which the directable lens is stepped, whereby it is obtained thinner than an equivalent normal lens.

The bottom of a reflecting surface 401 is parabolically designed and it has a protrusion 402 below a light source 403. The protrusion is designed and located so that light coming downwards of the light source is reflected from the protrusion past the light source. After the parabolic bottom, the reflecting surface has been stepped with transfer surfaces 406. The transfer surfaces are substantially perpendicular in respect of the reflecting surface. Then, in the reflecting surface are constituted step surfaces 405 which reflect light past the light source directly or by reflecting via a collar structure 404 and the reflecting surface substantially in the lighting direction. The transfer surfaces 406 between and adjacent to the step surfaces transfer the reflecting surface closer to the light source without changing the curvature of the reflecting surface. Then, the size of the lighting element can be minimised and the luminous efficiency per area unit can be increased.

The structure shown in FIG. 4 enables manufacturing the lighting element smaller of its diameter than e.g. in the embodiment shown in FIG. 2. In an embodiment, the inner surface of the collar structure can be stepped in accordance with the example shown in FIG. 4, whereby the same advantages as in the stepping of the reflecting surface will be achieved. Similarly, it is possible to step the outer surface of the collar structure equivalently. Then, the diameter of the collar structure can be decreased, but the curvature of the surface will not change.

FIG. 5 shows by way of an example a side view of a lighting element according to the invention, in which lighting element there is one light source and a parabolic reflecting surface. In the lighting element, there are a cover 507 and a stand 508. The stand is below the lighting element. The cover constitutes the sides of the lighting element. The cover and the stand constitute a system which protects the lighting element and there are means for joining lighting elements together mechanically and electrically to form a lighting arrangement. The lighting element is protected in the lighting direction by a plate-like protective structure 505. By this plate-like protective structure, it is still possible to change the tone and colour of light and to disperse the pointedness of the light source. In different embodiments of the invention, each lighting element can have its own protective structure or it covers the whole lighting arrangement or is a combination of these. The protective structure can be optically designed according to the intended use of the lighting arrangement.

In the lighting element, there is a reflecting surface 501. This advantageously constitutes the inner surface of the lighting element. The reflecting surface is of light-reflecting material. By the choice of the material and/or colour of the reflecting surface, the colour temperature of the light of the lighting element can be affected. The reflecting surface is designed such that it reflects light emitted by a light source 506 substantially in the lighting direction. The reflecting surface is partially parabolic. Substantially, this parabolic section is below the light source. The reflecting surface in areas 504 in the sideways direction of the light source and from the light source in the lighting direction is substantially uniform and of the shape of a funnel opening in the lighting direction. In the reflecting surface, there is a protrusion 502 the sides of which are curved. There is a peak in the protrusion. The protrusion is below the light source. The protrusion is designed such that it reflects light emitting downwards of the light source past the light source and a collar structure 503 surrounding it substantially in the lighting direction of the lighting element.

In the lighting element, there is the light source 506. The light source can e.g. be based on a filament, a halogen light, a light emitting diode, or based on a chemical reaction. The light source emits light substantially in every direction. In the lighting element, there is/are one or more support elements 509. These support elements keep the light source in place. The support elements are set substantially according to the travel direction of light, whereby they shade the light as little as possible. Furthermore, power required by the light source can be supplied to the light source via the support elements. For instance, it is possible to take an electric cord 510 inside the support element which supplies the light source with electric current or the support element itself is an electric conductor which is insulated with varnish or equivalent. Advantageously, the shapes and sizes of the support elements are such and they have been positioned so that they prevent the travel of light as little as possible. The support elements can have been arranged to come to the light source e.g. at the point of possible seams of the reflecting surface or they circulate the upper edge of the reflecting surface. In an embodiment, one end of the support element is fast in the protrusion of the reflecting surface and the other end in the light source. Advantageously, the support element is a tube-like or thread-like rigid structure. It can be coated with reflective material or manufactured of reflective material. The support element or some of them can also be fastened in the collar structure 503. The support elements can be designed such that they are heat-conductive, whereby they can be used for conveying heat away from the light source and/or the collar structure. The support elements are brought through the reflecting surface 501. There, the power required by the light source is connected to them. When using e.g. a LED light as the light source, the legs of the LED light component can directly operate as the support elements.

In the light source 506 of the lighting element is fastened the collar structure 503. This is a structure opening in the lighting direction manufactured of thin sheet which is fastened of its narrowing end in the light source. The fastening has been done so that it will not prevent light emitting downwards of the light source from accessing the reflecting surface. The collar structure has been manufactured of or coated with reflective material. The inner surface of the collar structure is the surface which is towards the light source and the outer surface is away from the light source. Advantageously, it is reflective both of its inner and outer surface. The collar structure has been designed such that its inner surface reflects light coming sideways from the light source substantially in the lighting direction. The outer surface of the collar structure reflects the light coming from the reflecting surface back on the reflecting surface from which the light is further reflected substantially in the lighting direction. This has been intended mostly for the diffused light of the lighting element which can thus be collected for utilisation. The material of the collar structure and its fastening in the light source have been chosen so that it conveys heat away from the light source. The shape of the collar structure seen from the lighting direction can be e.g. circular, elliptic or polygonal. The shapes of the inner and outer surfaces of the collar structure can differ from each other.

FIG. 6 shows by way of an example a lighting arrangement which is assembled of the lighting elements according to FIG. 5. A cover 507 of the lighting element is of hexagonal shape. Then, the lighting elements can be positioned in a honeycombed formation. Also other shapes are possible for the lighting element. In the covers of the lighting element, there are means for fastening the lighting elements together. Advantageously, the means for the electric coupling of the lighting elements are in the stands. In the light source 506 of the lighting element is fastened the collar structure 503. In the case according to the example, the collar structure is of hexagonal shape. Units can be assembled of the lighting element of which larger lighting arrangements can be assembled. By combining units consisting of lighting elements or several elements, it is easily possible to provide lighting arrangements for various targets and intended uses.

FIG. 7 is a top view of a lighting element according to the invention in which there are seven light sources 701. The light sources are located slightly separate from each other. The bottom of the reflecting surface is parabolic and there are protrusions which are below the light sources. Light emitting from the lower part of the light sources falls on the protrusions. The protrusions have been designed such that light falling on them is reflected past the light source substantially in the lighting direction. The inner surfaces of collar structures 702 surrounding the light sources reflect the light of the light source emitting sidewards in the lighting direction. The outer surfaces of the collar structures reflect diffused light fallen on them back on the reflecting surface from where it is further reflected.

FIG. 8 shows by way of an example a side view of a lighting element according to the invention, in which lighting element there are several light sources 805 and a bottom 802 of the reflecting surface is substantially even.

In the lighting element, there are a cover 806 and a stand 801. The figure shows two light sources: a first light source 805*a* and a second light source 805*b*. There can be more of the light sources. The light sources are located so that on top of the middle of the bottom of the reflecting surface there is no light source. The light sources have been inclined so that rays of light coming downwards of them, towards the bottom 802 of the reflecting surface, will never fall below the light source but closer to the middle of the reflecting surface. These rays of light are reflected from the bottom of the reflecting surface substantially in the lighting direction from between the first and the second light source. Sides 803 of the reflecting surface are substantially even and they constitute a structure opening in the lighting direction.

The light sources 805 have collar structures 804 the reflective inner surfaces of which reflect the light of the light source emitting sidewards substantially in the lighting direction. The outer surfaces of the collar structures reflect light reflected from the bottom 802 and the sides 803 of the reflecting surface back on the reflecting surface from which it is further reflected.

FIG. 9 shows the lighting element of FIG. 8 seen from the lighting direction. The cover 806 of the lighting element is of hexagonal shape. There are six light sources 805. The collar structures 804 of the light sources are of hexagonal shape. The light sources are arranged in a circle so that the collar structures of the light sources are fast in each other. In the middle of the circle constituted by the light sources and the collar structures remains a hexagonal opening 901. Similarly, between the circle constituted by the light sources and the collar structures and the cover of the lighting element remains an open space 902. Via the opening and the open space, light emitted downwards of the light sources is reflected from the middle of the bottom of the reflecting surface. Because the collar structures support each other, the structure becomes sturdy FIG. 10 shows by way of an example a lighting arrangement which is assembled of the lighting elements according to FIG. 9 in which there are six light sources 805 surrounded by collar structures 804. In the example, there are four lighting elements but various different combinations are possible. In these, the number and positioning of the lighting elements can vary. In the cover 806 of the lighting elements, there are means for fastening the lighting elements together.

FIG. 11 shows by way of an example a side view of a lighting element according to the invention in which lighting element there are several light sources. The figure shows a first light source 1101*a* and a second light source 1101*b*. This embodiment differs from the embodiment of FIG. 8 so that a bottom 1102 of the reflecting surface is substantially parabolic or curved and the light sources are substantially parallel with the longitudinal axis of the lighting element i.e. they are not inclined. Light coming downwards of the light sources is reflected from the reflecting surface between the first and the second light source substantially in the lighting direction. The lighting element according to the embodiment of FIG. 11 becomes brighter than the one of the embodiment of FIG. 8, because the light of the light sources goes in the same direction. The example of FIG. 11 can be implemented in accordance with FIG. 9 by positioning the light sources of the lighting element in the form of a circle, whereby light emitted downwards of the light sources is reflected from the opening of the circle and from between the circle and the cover of the lighting element in the lighting direction.

In an embodiment according to FIG. 11, the bottom of the reflecting surface consists of six identical triangular parts the peaks of which join in the middle of the bottom of the lighting element. In another embodiment, the reflecting surface is a combination of a parabolic and an even surface.

FIG. 12 shows by way of an example a side view of a lighting element according to the invention. In the lighting element, there are several light sources which are set in the form of a circle in accordance with the example of FIG. 9. FIG. 12 shows a first light source 1201*a* and a second light source 1201*b*. This embodiment differs from the embodiment of FIG. 8 so that the light sources are substantially parallel with the longitudinal axis of the lighting element, i.e. they are not inclined, and in the reflecting surface 1202 there is a ridge-like protrusion 1207 which is of the form of the circle constituted by the light sources. The protrusion has a peak and curved sides and it is located substantially below the light sources. The sides of the protrusion are designed such that it reflects the light emitted downwards of the light sources past the light sources substantially in the lighting direction.

FIG. 13 shows the lighting element of FIG. 12 seen from the lighting direction. A cover 1206 of the lighting element is of hexagonal shape. There are six light sources 1205. Collar structures 1204 of the light sources are of hexagonal shape. The light sources are arranged in a circle so that the collar structures of the light sources are fast in each other. In the middle of the circle constituted by the light sources and the collar structures remains a hexagonal opening 1301. Similarly, between the circle constituted by the light sources and the collar structures and an inner surface 1203 of the cover of the lighting element remains an open space 1302. The ridge of the protrusion 1207 remaining below the light sources is designated with dash line in the figure. Via the opening and the open space, light emitted downwards of the light sources is reflected via, the protrusion. Because the centre points of the light sources form a hexagon, also the protrusion is of hexagonal shape. The protrusion and its ridge are designed such that about one third of the light emitting downwards of the light source is reflected via the opening 1301 and about two thirds via the open space 1302. Also other shapes are possible for the protrusion.

FIG. 14 shows an example of a lighting element according to the invention in which the support elements are implemented by light sources 1401 surrounded by collar structures 1402. The collar structures and an inner edge 1403 of the cover of the lighting element are of hexagonal shape. Compared to the example of FIG. 9, two light sources surrounded by collar structures have been added in the lighting element of FIG. 14: a first light source 1401*a* and a second light source 1401*b*. The first and the second light source are located so that their sides are located with the sides of a circle constituted by six light sources surrounded by collar structures. Advantageously, the first and the second light source are on the opposite sides of the circle, whereby the structure becomes sturdy. The first and the second light source support themselves on the inner edge of the cover of the lighting element with their sides which are on the opposite side of sides fastened in the circle. The first and the second light source are located at the corners of the inner edge of the cover of the lighting element. The power of the light sources of the lighting element comes via the first and/or second light source. The power can be conveyed by a suitable set either through the cover or it comes over the upper edge of the cover. In an embodiment, the cover of the lighting element can be designed such that it is of the shape of the outer side of the structure constituted by the collar structures. Then, the cover of the lighting element is from every direction in connection with the outer side of the structure formed by the collar structures. The light emitting downwards of the light sources is reflected from an opening 1406 in the middle of the circle constituted by the collar structures.

FIG. 15 shows another example of a lighting element according to the invention in which the support elements are implemented by light sources 1501 surrounded by collar structures 1502. Six light sources surrounded by collar structures are positioned as a circle. Here, one side of the hexagonal collar structure of each light source supports itself on a hexagon-shaped inner edge 1503 of the cover of the lighting element. The power required by the light sources can be brought through the cover or over the upper edge of the cover. The structure according to FIG. 15 is very sturdy.

FIG. 16 shows an example of a lighting element according to the invention in which there are seven lighting elements 1602. In the figure, the lighting arrangement is shown from the top. The lighting elements are hexagonal and they are designed such that they can be located substantially so that the lighting arrangement becomes of the shape of a hemisphere or spherical segment. In the lighting arrangement, there is a stand structure 1601. The structure constituted by the lighting elements fastened in each other is fastened in the stand structure. In the stand structure, there are means for supplying the power to the lighting elements and means for fastening the lighting arrangement in its place of use and for supplying the power to the lighting arrangement.

FIG. 17 is a cross section of the lighting arrangement according to FIG. 16. The cross section is drawn along the dot-and-dash line in FIG. 16 so that it passes via three lighting elements 1602*a*, 1602*b* and 1602*c*. In the lighting element, there are a cover 1605 and a stand 1606. The cover and the stand are designed such that the lighting element becomes of such shape that the lighting elements can be located substantially in the shape of a hemisphere or spherical segment. The lighting elements of the lighting arrangement do not have to be necessarily similar. In an area between the middle lighting element 1602*b* and the stand structure 1601, it is possible to locate means for conveying power and fastening and support structures. In an example according to FIG. 17, light sources 1603 and a reflecting surface 1604 of the lighting elements are arranged so that the lighting directions of the lighting arrangement elements are substantially parallel with the longitudinal axes of the lighting arrangement elements. Then, the lighting arrangement emits light to the whole semispace. By combining two of the described lighting arrangements, a spherical lighting arrangement is provided.

It is also possible to make e.g. a lighting arrangement in which the light sources 1603 and the reflecting surface 1604 of the outmost lighting elements are set so that their lighting direction has substantially turned in the same direction with the lighting direction of the middle lighting element 1602*b*. In this case, the light beam of the lighting arrangement is narrower and simultaneously brighter.

FIG. 18 shows an example of a lighting arrangement which consists of one lighting element according to the invention. The lighting arrangement is quite similar to the example shown in FIGS. 16 and 17, but it is an individual lighting element according to the invention. In the lighting element, there are a reflecting surface, a stand 1802, light sources 1809, and a hemispherical protective structure 1806. In the stand, there are means for the mechanic and electric joining of the lighting element. Advantageously, the means convey power to the light sources, wirings and other possibly required components are located in an area 1807 remaining between the reflecting surface and the stand.

The reflecting surface consists of several different parts. On the edge areas of the lighting element, the reflecting surface 1801*a, b* is parabolic below the light sources 1809 and in the middle area of the lighting element the reflecting surface 1803 is even below the light sources. The parts below the light sources of the reflecting surface reflect light coming on them from the light sources past the light sources in the lighting direction. Reflecting surface areas of different shapes are separated by ridge structures 1808. Their sides are also of the reflecting surface. The reflecting surface 1805 against the stand 1802 can be designed for directing the light.

In the lighting element according to the example of FIG. 18, the light of several small light sources can be collected and directed at the use target. The light sources can be located for facilitating the assembly and the supply of power as a formation consisting of several light sources. An advantageous formation is a circle consisting of six light sources. In the case according to the example, there are seven of these circles. Then, quite high luminous efficiency is provided. By choosing the shapes of the reflecting surface and the positions of the light sources, the lighting direction can be altered and directed.

Also other shapes of lighting arrangements assembled of lighting elements are possible than the lighting arrangements of plane surface and spherical segment shapes described here.

The lighting arrangement can include various lighting elements. For instance, there can be mixed lighting elements of one light source and several light sources in the lighting arrangement. Then, brighter light is provided at some point of the lighting arrangement. The lighting directions of the lighting elements of the lighting arrangement can be different at different points of the lighting arrangement, whereby more light is provided at some certain point. Also, the outputs and other properties of the light sources can vary.

The reflecting surface of the lighting element can be a combination of different shapes of a reflecting surface. Different light sources of the lighting element can have a different reflecting surface below them. Also, the light sources need not be on the same plane.

It is possible to use several types of devices as the light sources in lighting elements. It is substantial that the light source emits light in different directions. Here, known arrangements can be utilised. Usually, electric light sources are used, whereby the power is electric current. The light emitting diode i.e. the LED light is an advantageous choice for the light source. The light emitting diode emits light also sideways and backwards and the invention enables their utilisation. This makes the relation of price and luminosity of the LED light more cost-effective. The invention also helps to eliminate many disadvantages coming up in the lighting use of the light emitting diode, which are e.g. the low luminous efficiency of a single light emitting diode and its spot-like quality. The invention also helps to save energy when low-power light sources can be used in the lighting arrangement for providing the same luminosity. The invention is, also applicable to gas-discharge lamps or a filament, whereby the lighting element is constructed inside the lamp. A possible light source is also optical fibre in which the emitting end of the optical fibre is the front part of the light source and the base part of the optical fibre in which light is supplied to the optical fibre is the back part of the light source.

Some advantageous embodiments according to the invention were described above. The invention is not limited to the above-described solutions, but it is possible to apply the inventive idea with several ways within the limitations set by the claims.

The invention claimed is:

1. A lighting element which comprises:

a concave reflecting surface;

a plurality of light sources arranged to illuminate in at least a primary lighting direction and each light source being located with respect to the concave reflecting surface so that light coming from each light source toward the concave reflecting surface is reflected past the light sources substantially in the primary lighting direction;

a power supply for supplying power to each light source;

a plurality of collar structures that are connectable to one another, each forward of at least a central part of the concave reflecting surface in the primary lighting direction and each of which is fastened around a respective light source in such a way as to define a hole through which light from said light source can pass in a direction opposite the primary lighting direction; wherein the plurality of collar structures are arranged to reflect light emitting sideways from the light sources substantially in the primary lighting direction of the lighting element.

2. A lighting element according to claim 1, wherein the shape of the concave reflecting surface is at least partially parabolic.

3. A lighting element according to claim 1, wherein the bottom of the concave reflecting surface is at least partially flat.

4. A lighting element according to claim 1, wherein in the concave reflecting surface there is/are one or more protrusions to direct the light past the light source or light sources.

5. A lighting element according to claim 1, wherein the walls of the concave reflecting surface are stepped in accordance with the Fresnel reflecting surface.

6. A lighting element according to claim 1, wherein each light source has one or more support elements and power is suppliable to each light source via the support element or support elements.

7. A lighting element according to claim 1, wherein the collar structure is heat-conductive for conveying heat away from the light source.

8. A lighting element according to claim 1, wherein in the collar structure there is an inner and/or outer surface which reflects light.

9. A lighting element according to claim 1, wherein the inner and/or outer surface of the collar structure is designed to control the reflection of light.

10. A lighting element according to claim 1, wherein the light sources surrounded by the collar structures are arranged in the form of a circle.

11. A lighting element according to claim 6, wherein the collar structures serve as the support elements.

12. A lighting element according to claim 1, wherein in the lighting element there is a cover and a stand, the outer side of which is designed such that the lighting element is connectable to other lighting elements to form a lighting arrangement consisting of several lighting elements.

13. A lighting element according to claim 12, wherein the lighting arrangement consisting of the lighting elements is planar.

14. A lighting element according to claim 12, wherein the outer surface of the lighting arrangement consisting of the lighting elements is a curved surface.

15. A lighting element according to claim 12, wherein the cover and the stand of the lighting element are designed in the form of a hexagon.

16. A lighting element according to claim 1, wherein the light sources are electric light sources and the power is electric current.

17. A lighting element according to claim 1, wherein the light sources are LEDs.

18. A lighting element according to claim 1, wherein the light source is a filament.

* * * * *